US010293971B2

(12) United States Patent
van Waarden

(10) Patent No.: US 10,293,971 B2
(45) Date of Patent: May 21, 2019

(54) RECLOSABLE PAPERBOARD CARTON

(71) Applicant: Velcro BVBA, Deinze (BE)

(72) Inventor: Arjan van Waarden, Oosterhout (NL)

(73) Assignee: Velcro BVBA (BE)

( * ) Notice: Subject to any disclaimer, the term of this patent is extended or adjusted under 35 U.S.C. 154(b) by 0 days.

(21) Appl. No.: 15/290,241

(22) Filed: Oct. 11, 2016

(65) Prior Publication Data

US 2018/0099775 A1 Apr. 12, 2018

(51) Int. Cl.

| | |
|---|---|
| ***B65D 5/66*** | (2006.01) |
| ***B65D 5/68*** | (2006.01) |
| ***B65D 43/16*** | (2006.01) |
| ***B65D 5/64*** | (2006.01) |

(52) U.S. Cl.

CPC ..... *B65D 5/6611* (2013.01); *B65D 5/643* (2013.01); *B65D 5/66* (2013.01); *B65D 5/68* (2013.01); *B65D 5/685* (2013.01); *B65D 43/162* (2013.01); *B65D 2313/00* (2013.01)

(58) Field of Classification Search

CPC .... B65D 5/6611; B65D 5/685; B65D 43/162; B65D 33/2541; B65D 5/6608; B65D 2203/12; B65D 2313/02; B65D 5/2057; A44B 18/0073; A44B 18/0061; A44B 18/008; A44B 18/0007; A44B 18/0046; A44B 13/0052

USPC ..... 229/247, 245, 125, 122.26, 126; 24/442, 24/306, 584.1, DIG. 38, DIG. 43, 449; 428/99, 167; 156/152, 312; 383/63

See application file for complete search history.

(56) References Cited

U.S. PATENT DOCUMENTS

| | | | |
|---|---|---|---|
| 184,397 | A | 11/1876 | Macumber |
| 560,373 | A | 2/1897 | Wildern, IV et al. |
| 2,203,127 | A | 6/1940 | Borah |
| 2,226,215 | A | 12/1940 | Borah |
| 2,461,201 | A | 2/1949 | Ellis |
| 2,574,384 | A | 11/1951 | Walter et al. |
| 3,462,802 | A | 8/1969 | Merser |

(Continued)

FOREIGN PATENT DOCUMENTS

| | | |
|---|---|---|
| EP | 0399574 | 11/1990 |
| EP | 0741979 | 11/1996 |

(Continued)

OTHER PUBLICATIONS

European Office Action in European Application No. 05723824.8, dated Mar. 5, 2008, 5 pages.

(Continued)

*Primary Examiner* — Christopher Demeree
(74) *Attorney, Agent, or Firm* — Fish & Richardson P.C.

(57) ABSTRACT

A reclosable carton has a releasable closure, with one portion of the closure adhered to a wall of the carton body, and a mating portion of the closure adhered to a flange of a lid of the carton, such that the closure portions overlap with the lid closed. Each closure portion has an exposed surface defining a series of tapered ridges, each formed as a row of tapered scallops, spaced apart in a box lid closing direction, such that the ridges of one closure portion sequentially engage the ridges of the other closure portion as the lid is closed, to hold the lid in its closed position. The closure is subsequently released by flexure of the carton body or lid to separate the engaged ridges.

24 Claims, 15 Drawing Sheets

(56) References Cited

U.S. PATENT DOCUMENTS

| | | | | |
|---|---|---|---|---|
| 3,462,805 | A | 8/1969 | Quisling | |
| 3,462,806 | A | 8/1969 | Quisling | |
| 3,748,697 | A | 7/1973 | Murasaki | |
| 3,964,133 | A | 6/1976 | Wasserlein, Jr. | |
| 4,198,734 | A | 4/1980 | Brumlik | |
| 4,183,121 | A | 6/1980 | Cousins | |
| 4,271,566 | A | 6/1981 | Perina | |
| 4,537,432 | A | 8/1985 | Meeks | |
| 4,557,024 | A | 12/1985 | Roberts et al. | |
| 4,680,838 | A | 7/1987 | Astl | |
| D294,768 | S | 3/1988 | Famolare, Jr. | |
| 4,775,310 | A | 10/1988 | Fischer | |
| 4,794,674 | A | 1/1989 | Mintel et al. | |
| 4,863,127 | A | 9/1989 | Handler | |
| 4,879,854 | A | 11/1989 | Handler | |
| 4,887,338 | A | 12/1989 | Handler | |
| 4,887,339 | A | 12/1989 | Bellanger | |
| 4,941,238 | A | 7/1990 | Clark | |
| 5,005,242 | A | 4/1991 | Kennedy et al. | |
| 5,101,539 | A | 4/1992 | Kennedy et al. | |
| 5,179,767 | A | 1/1993 | Allan | |
| 5,208,952 | A * | 5/1993 | Mintel | A43C 11/00 24/584.1 |
| 5,212,853 | A | 5/1993 | Kaneko | |
| 5,216,784 | A | 6/1993 | Dyer | |
| 5,345,659 | A | 9/1994 | Allan | |
| 5,368,549 | A | 11/1994 | McVicker | |
| 5,499,859 | A | 3/1996 | Angell | |
| 5,640,744 | A | 6/1997 | Allan | |
| 5,653,004 | A | 8/1997 | Russo | |
| 5,656,014 | A | 8/1997 | Rooney et al. | |
| 5,657,516 | A | 8/1997 | Berg et al. | |
| 5,704,480 | A | 1/1998 | Scholz et al. | |
| 5,753,332 | A | 5/1998 | Hsu | |
| 5,766,723 | A | 6/1998 | Oborny et al. | |
| 5,781,969 | A | 7/1998 | Akeno et al. | |
| 5,826,312 | A | 10/1998 | Schroder et al. | |
| 5,827,547 | A | 10/1998 | Burchi et al. | |
| 5,882,073 | A | 3/1999 | Burchi et al. | |
| 5,913,482 | A | 6/1999 | Akeno | |
| 5,945,193 | A | 8/1999 | Pollard et al. | |
| 5,953,797 | A | 9/1999 | Provost et al. | |
| 5,964,017 | A | 10/1999 | Roberts | |
| 5,983,467 | A | 11/1999 | Duffy | |
| 6,085,394 | A | 7/2000 | Hartman | |
| 6,129,970 | A | 10/2000 | Kenney et al. | |
| 6,311,362 | B1 | 11/2001 | Arbogast | |
| 6,432,339 | B1 | 8/2002 | Jens et al. | |
| 6,487,759 | B1 | 12/2002 | Akeno et al. | |
| 6,625,851 | B1 | 9/2003 | Martin et al. | |
| 6,668,429 | B2 | 12/2003 | Fujisawa et al. | |
| 6,911,171 | B2 | 6/2005 | Lauer | |
| 7,117,536 | B2 | 10/2006 | Burnett et al. | |
| 7,212,869 | B2 | 5/2007 | Wahlstrom et al. | |
| 7,478,460 | B2 | 1/2009 | Gallant et al. | |
| 9,346,582 | B2 * | 5/2016 | Pinkstone | B65D 5/5415 |
| 9,360,029 | B2 * | 6/2016 | Wallace | F16B 2/00 |
| 9,481,486 | B2 * | 11/2016 | Nameth | B65D 5/5425 |
| 2002/0023322 | A1 | 2/2002 | Murasaki | |
| 2002/0078536 | A1 | 6/2002 | Martin et al. | |
| 2003/0074771 | A1 | 4/2003 | Duffy | |
| 2008/0217205 | A1 | 9/2008 | Sattel et al. | |
| 2009/0001145 | A1 | 1/2009 | Hasse et al. | |

FOREIGN PATENT DOCUMENTS

| | | |
|---|---|---|
| EP | 1783058 | 5/2007 |
| EP | 2382136 | 11/2011 |
| GB | 2450097 | 12/2008 |
| JP | 2007254028 | 10/2007 |
| JP | 5621329 | 11/2014 |
| WO | WO 98/29003 | 7/1998 |
| WO | WO 00/00407 | 1/2000 |
| WO | WO 00/07792 | 2/2000 |
| WO | WO 00/18556 | 4/2000 |
| WO | WO 01/12022 | 2/2001 |
| WO | WO 01/37710 | 5/2001 |
| WO | 2014/039930 | 3/2014 |

OTHER PUBLICATIONS

International Search Report and Written Opinion in International Application No. PCT/US2005/006121, dated Aug. 1, 2005, 9 pages.
International Search Report and Written Opinion in International Application No. PCT/EP2017/075322, dated Dec. 19, 2017, 13 pages.

* cited by examiner

RECLOSABLE PAPERBOARD CARTON

TECHNICAL FIELD

This invention relates to reclosable cartons, and more particularly to releasable closures for cartons made primarily of paperboard, such as for product packaging.

BACKGROUND

Cartons are semi-rigid, three-dimensional structures for enclosing products. By semi-rigid I mean that they maintain a general shape but can be flexed, and return to their general shape after moderate, non-creasing flexure. Inexpensive cartons are commonly formed of paperboard, either entirely of heavy paper card stock or of paperboard that consists of a coated paper material. Some cartons have hinged lids that can be repeatedly opened to access carton contents. Improvements are sought for closures for such lidded cartons, particularly closures that prevent unwanted carton opening and accommodate some closure misalignment.

SUMMARY

One aspect of the invention features a reclosable carton having a carton body and an associated lid. The carton body has at least four walls and a bottom and defines an opening into an interior compartment defined between the walls. The walls and bottom are formed by a folded piece of paperboard. The carton lid has flanges that overlap upper portions of at least two of the walls of the carton body with the lid in a closed position. The carton also includes a closure having two portions: a body closure portion adhered to an outer surface of an upper portion of one of the carton body walls, and a lid closure portion adhered to an inner surface of one of the carton lid flanges. The lid closure portion is arranged to overlap the body closure portion with the lid in its closed position. Each of the body and lid closure portions has an exposed surface defining a series of tapered ridges formed of thermoplastic resin and spaced apart in a box lid closing direction. The ridges of the lid closure portion are configured to sequentially engage the ridges of the body closure portion as the lid is closed, to hold the lid in its closed position. The carton closure is releasable by flexure of the carton body or lid to separate the engaged ridges of the body and lid closure portions.

In some cases, the thermoplastic resin of the ridges has a durometer of between 10 and 100 Shore D, preferably between 40 and 100, more preferably between 60 and 100, as tested according to ASTM 2240.

In some cartons, the lid extends from one of the walls of the carton body at a paperboard hinge. The body closure portion is preferably positioned adjacent a corner of the carton opposite the hinge.

In some cartons, the body closure portion is attached to a body flange depending from an upper edge of the body as part of an upper portion of a body side wall.

Preferably, the ridges of at least one of the body and lid closure portions, more preferably of both of the body and lid closure portions, each features or is formed as a row of scallops. Each scallop forms a wedge-shaped, engageable element extending integrally from at least one side of a sheet-form base of the closure portion. The engageable elements each have an engageable side and a non-engageable side conterminous at an upper edge of the element.

Preferably, the upper edge of each engageable element defines a curve in top view, and wherein the engageable sides of a majority of the elements are oriented in a common direction. The scallops face such that their non-engageable sides make initial contact with the scallops of the other closure portion during lid closure.

The scallops may be arranged in an array of multiple rows and columns. The scallops may be arranged in multiple rows, with scallops of adjacent rows offset from one another along their respective rows, such as with the scallops of adjacent rows offset by about one-half a nominal spacing between adjacent scallops within a row.

The curve defined by the upper edge in top view may be substantially circular with a constant radius of curvature, and the non-engageable side of each fastener element may rise from the sheet-form base at an angle of between about 5 and 45 degrees.

In some cases the engageable sides of the wedge-shaped elements overhang the sheet-form base. For example, the engageable side of each fastener element may extend downward from the upper edge toward the sheet-form base at an undercut angle, measured in a midplane bisecting the fastener element and perpendicular to the sheet-form base, of between about 10 and 45 degrees.

In some configurations, the body and lid closure portions are of identical structure, and may be formed entirely of the thermoplastic resin.

The body and lid closure portions may be adhered to paperboard of the carton by pressure-sensitive adhesive.

In some embodiments, the body closure portion includes at least two body closure sections spaced apart on the carton body and separated by exposed carton body surface, and the lid closure portion includes a set of corresponding lid closure sections spaced apart on the carton lid and separated by exposed carton lid surface. Each body closure section is aligned with a lid closure section to overlap upon lid closure to secure the lid in its closed position.

In some examples the body closure sections are displaceable by manipulable surfaces spaced apart by a distance of at least 4 inches (10 cm), so as to not be simultaneously operable by a single hand of a child.

In some cases two of the body closure sections are disposed on opposite sides of the carton body. In some cases two body closure sections are disposed on a single side of the carton body, opposite a paperboard hinge.

In some examples the flanges of the lid are joined to form a skirt about a perimeter of the lid, and the lid is completely removable from the body by releasing the closure. The body closure portion may be attached to a body flange depending from an upper edge of the body as part of an upper portion of a body side wall, such that the skirt of the lid overlaps the body flange with the lid it its closed position. In some cases the skirt defines a cutout in which a region of the body flange is exposed with the lid in its closed position. The body closure portion may have multiple body closure sections carried on respective body flanges on respective sides of the carton body, with the lid closure portion having multiple lid closure sections carried on respective inner surfaces of the lid skirt so as to engage the body closure sections on multiple sides of the carton.

For some applications, the sides of the carton body have a Gurley stiffness of between 15,000 and 100,000 Gurley units (mg of force), preferably between 20,000 and 70,000, as tested according to TAPPI test method T543.

The carton lid and the sides of the carton body may be formed of coated paper.

Reclosable cartons incorporating the closure described herein can be readily manufactured using standard paperboard products and flexible thermoplastic 'labels' forming the closure portions, adhered to the carton blanks prior to folding. The closures provide a reliable resin-resin engagement, and durometers can be selected for a pleasing tactile feedback during closure. The ridges are readily sized to allow opening under elastic flexure of carton body or lid panels of typical carton paperboard stiffness.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
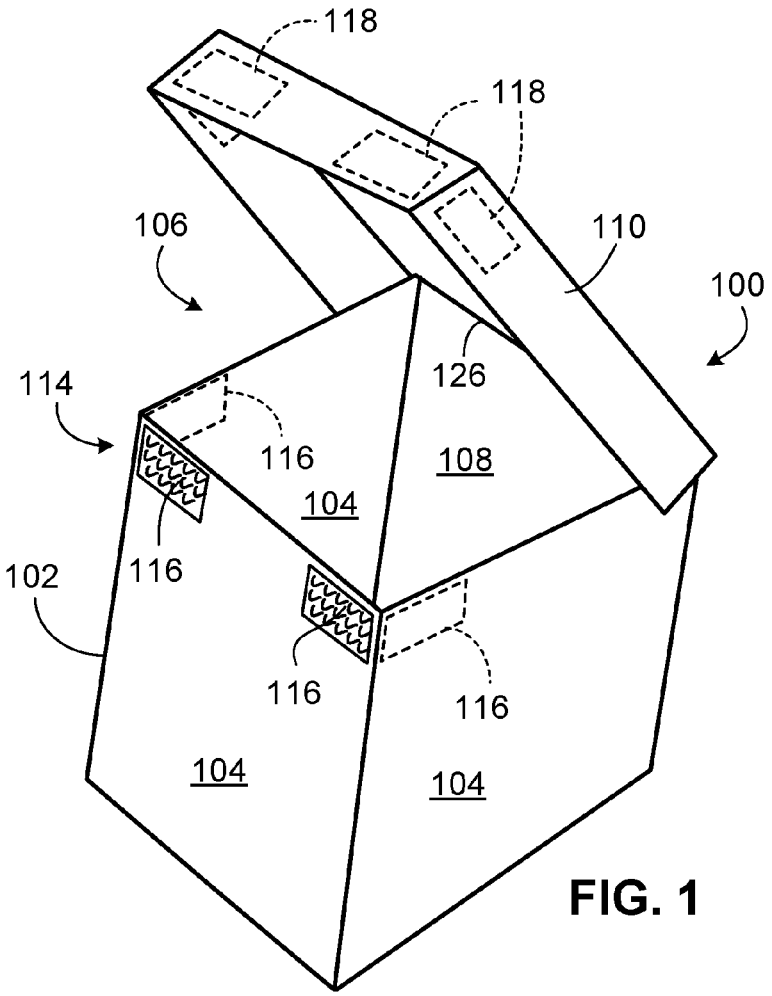
FIG. 1 is a perspective view of a carton featuring a releasable closure, showing multiple alternative closure configurations.

Referring first to FIG. 1, a reclosable carton 100 has a carton body 102 having four walls 104 and a bottom (not shown) and defining an opening 106 into an interior compartment 108 defined between the walls. The walls and bottom are respective portions of a single, folded piece of paperboard. The carton has a lid 110 with flanges 112 that overlap upper portions of three of the walls 104 of the carton body 102, when the lid in a closed position. The carton has multiple closures 114, each formed by a respective body closure portion 116 adhered to an outer surface of an upper portion of one of the carton body walls 104, and a respective lid closure portion 118 adhered to an inner surface of one of the carton lid flanges 112. The body and lid closure portions are arranged to overlap with the lid in its closed position, to hold the lid in its closed position.

Figure 2:
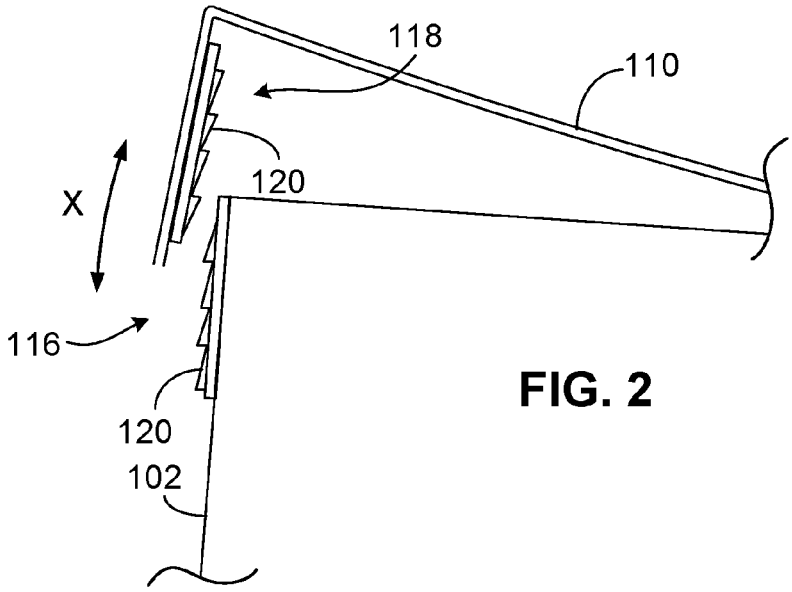
FIG. 2 is a partial side cross-section through the carton and its hinged lid, showing the closure in the process of being engaged to retain the lid in a closed condition.

As shown in FIG. 2, each of the lid and carton closure portions has an exposed surface defining a series of tapered ridges 120 spaced apart in a box lid closing direction 'X'. As lid 110 is lowered to overlap the closure portions, the ridges 120 of the lid closure portions 118 ratchet past the ridges 120 of the body closure portions 116, with minor elastic deformation of the carton walls as the ridges 120 snap over each other. In this sense the ridges of each closure portion can be said to sequentially engage the ridges of the other closure portion as the lid is closed.

Figure 3:
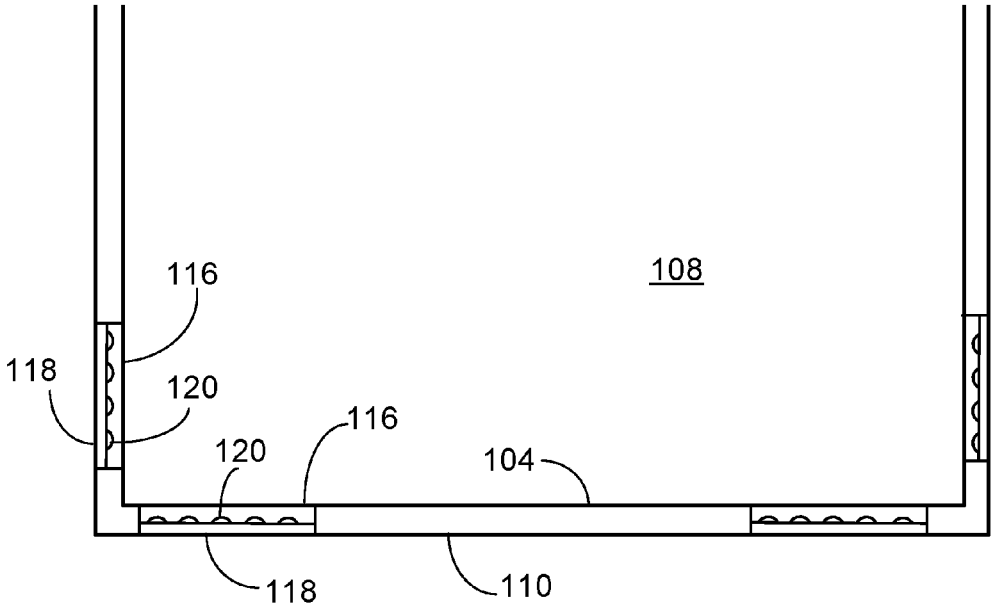
FIG. 3 is a partial cross-section, looking down into the carton and showing the engaged closures.

With the lid closed as shown in FIG. 3, the ridges 120 of the lid and carton closure portions are nested and interference between them resists lid opening force.

Figure 4:
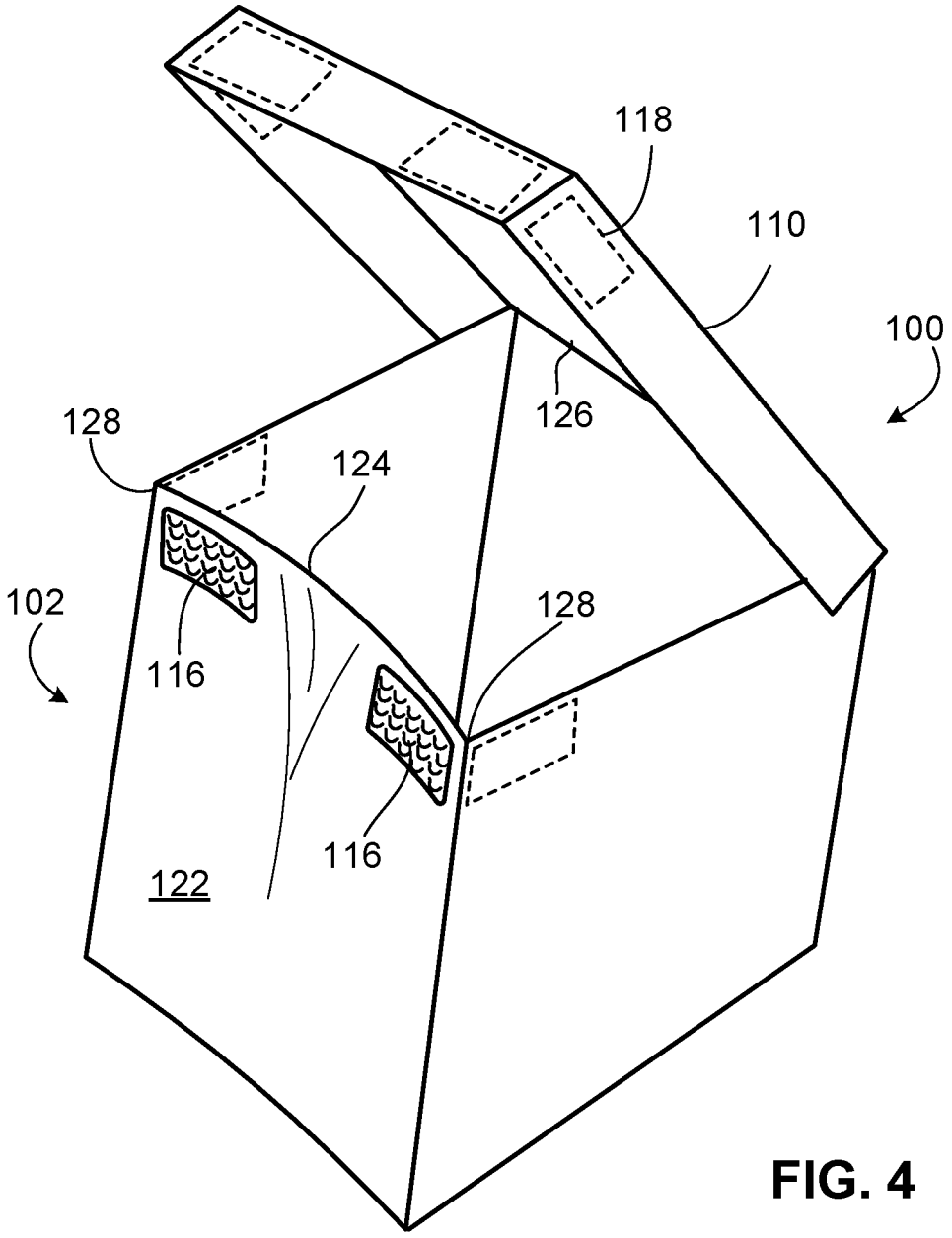
FIG. 4 shows the carton of FIG. 1, with the front wall of the carton flexed to release the closures.

To release the closure, one simply flexes the carton body (or lid) to separate the engaged ridges 120 of the body and lid closure portions, as illustrated in FIG. 4. The separation caused by the flexure is normal to the engaged faces of the closure portions, such that the ridges of each closure portion are 'lifted' from the face of the other closure portion so that the closure portions can move across one another without engagement of their ridges. The flexure illustrated in FIG. 4 is primarily of the front face of carton 102, by elastically buckling or bending the face near its upper edge 124. Due to the size of the ridges, only a small amount of flexure is sufficient to displace the body closure portions 116 inward, away from the lid closure portions 118. Alternatively, the lid flange may be flexed outward from the carton body sides to release the closure. Preferably, the portion of the carton to be flexed is elastically flexible over the distance required to release the closures, and with a Gurley stiffness of between about 15,000 and 100,000 Gurley units (mg of force), more preferably 20,000 to 70,000, as tested according to TAPPI test method T543. The carton 100 of FIGS. 1 and 4 is shown with closures on the front face of the carton, opposite a paperboard hinge 126 connecting the carton body 102 and lid 110. The lid and body of carton 100 are thus formed from one folded piece of paperboard. By paperboard I mean a semirigid substrate having at least a core comprising wood pulp. The paperboard may or may not have a protective coating, such as a wax or resin. The paperboard may have only a single homogenous layer of relatively thick paper, or may have two paper layers sandwiching a corrugation layer. The core may include stiffeners and other additives in addition to the wood pulp. Paperboard is a common packaging material, and may be recyclable or in some cases compostable.

Carton 100 may have closures in any combination or all of the positions shown in FIGS. 1 and 4. The body closure portions 116 shown in solid line on the front face of the carton are of closures positioned on the face opposite (farthest from) hinge 126, and are shown positioned adjacent front corners 128 of the carton body. Other useful closure positions are shown on the carton body in dashed outline, on side faces of the carton body, also adjacent corners 128.

Figure 5:
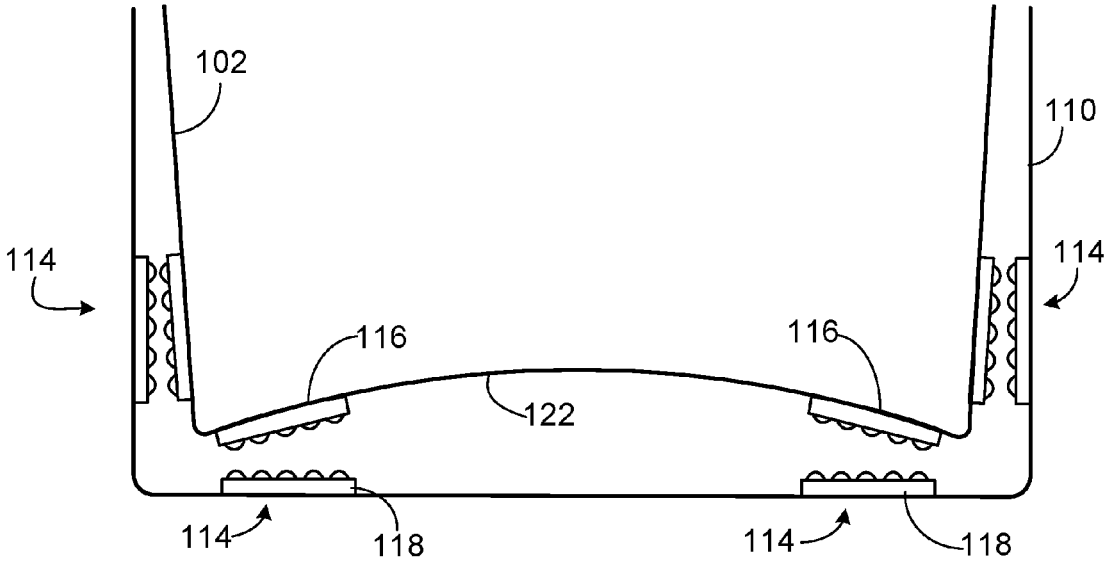
FIG. 5 is a partial cross-section, looking down into the carton and showing the closures released by flexure of the carton wall.

Corresponding lid closure portions 118 are also shown in dashed outline. In some cases, the body closure portions 116 are positioned on only the side faces, in some cases only on the front face, and in other examples are included on both front and side faces. As shown in FIG. 5, closures 114 in any of these positions will be separated by a gentle, non-creasing flexure of the front face 122 of the carton body. Such flexure can be created by gently pressing inward on the front face of the body, between the closures, just below the lid. When the pressure is removed, the carton body essentially returns to its pre-flexed condition, such that the closures will re-engage upon closing of the lid.

Figure 6:
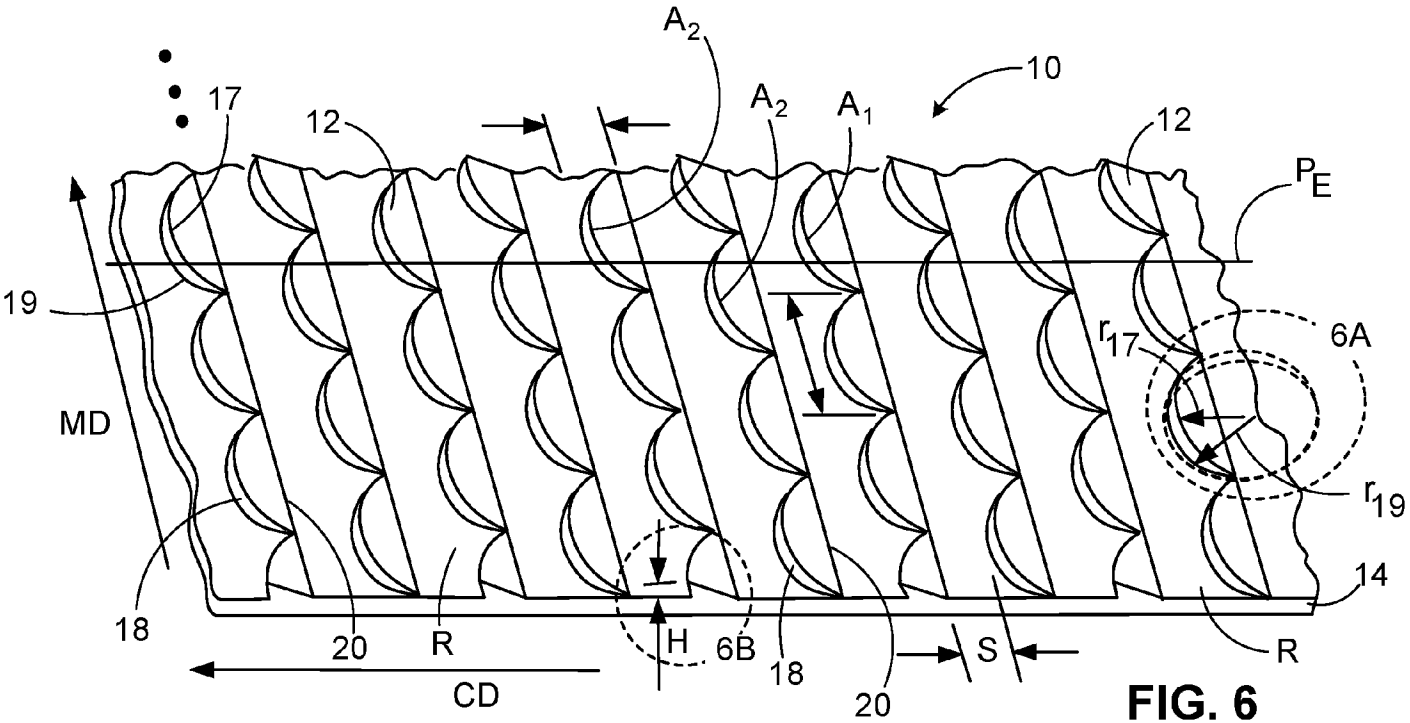
FIG. 6 is a perspective view of a closure portion.
Figure 6A:
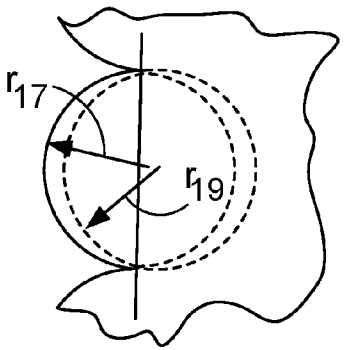
FIG. 6A is an enlarged view of area 6A of FIG. 6.
Figure 6B:
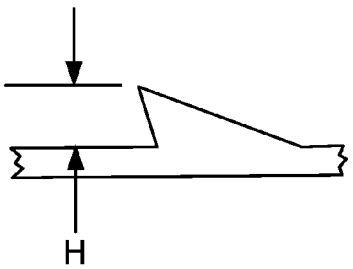
FIG. 6B is an enlarged side view of area 6B in FIG. 6.

Referring to FIG. 6, each closure portion 10 (whether a body closure portion 116 or a lid closure portion 118, as shown in FIG. 1) includes an array of arcuate engageable elements 12 integrally molded with and extending outwardly from one side of a solid sheet-form base 14. The engageable elements 12 are arranged in scalloped rows R, each row forming one of the ridges of the closure portion, and are preferably staggered, as shown. The engageable elements 12 each include an engageable side 18 and a non-engageable side 20 disposed opposite the engageable side. Preferably, the elements are substantially identical to each other, as shown.

The engageable elements 12 may be formed by a process having a machine direction (MD) and a cross-machine direction (CD), in which case the engageable elements 12 may be arranged with rows R extending in the machine direction so that engageable sides 18 face uni-directionally in the cross-machine direction. Each engageable side 18 is defined by an upper edge 17 and by a lower edge 19 where the engageable element intersects the sheet-form base 14. Both upper and lower edges 17, 19 define curves, for example, a circular curve as shown in FIG. 1, in the direction of the rows, for example, the machine direction. A circular curve is a curve that would sweep out a circle if it continued. Because the elements 12 are staggered, the apexes A1, A2 of the arcuate engageable elements 12 in adjacent rows are offset from each other. On the carton, the closure portion is arranged such that the CD direction is aligned with the lid closing direction 'X' of FIG. 2, with the engageable sides 18 of the elements facing away from the carton body opening. Thus, as the lid is closed, the non-engageable sides of the engageable elements slide over one another in a ratcheting motion.

Preferably, each closure portion 10 is made of thermoplastic material having a durometer between 10 and 100 Shore D, preferably between 40 and 100, more preferably between 60 and 100, as tested according to ASTM 2240. Suitable thermoplastic materials may include polyethylenes, polypropylenes, polyamides, PVC, and polyesters. Pro-fax SD242, a polypropylene impact copolymer from Lyondell-Basell Industries, is a suitable material. We have found that the relatively soft durometer of the ridges of the closure portions can provide a pleasing engagement 'feel' while providing a reliable resistance to undesired opening. Particularly with a staggered arrangement of scallops, the ratcheting feel is pleasingly soft. The staggered scallop arrangement also helps to accommodate relative angles between the mating ridges, as occurs during angulation of a hinged lid during closing, for example.

Figure 7:
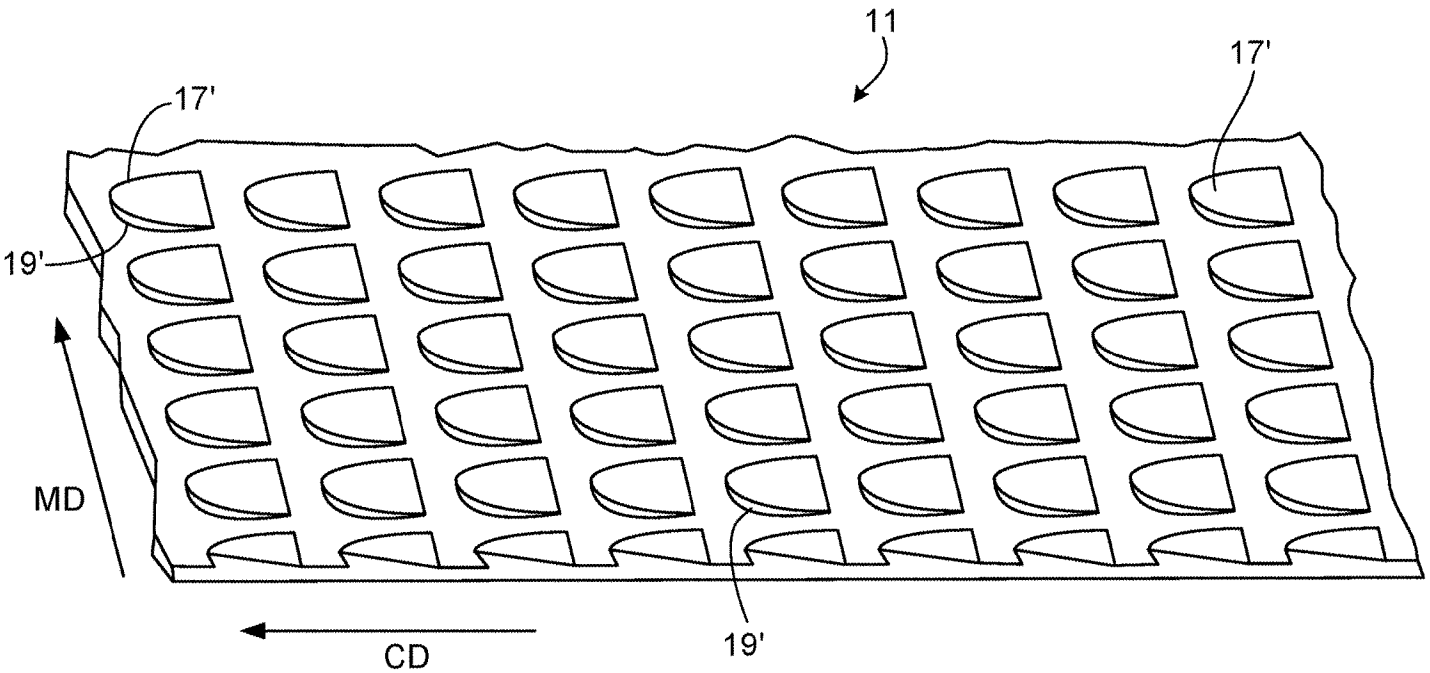
FIGS. 7 and 8 are perspective and top views of a second closure portion.
Figure 8:
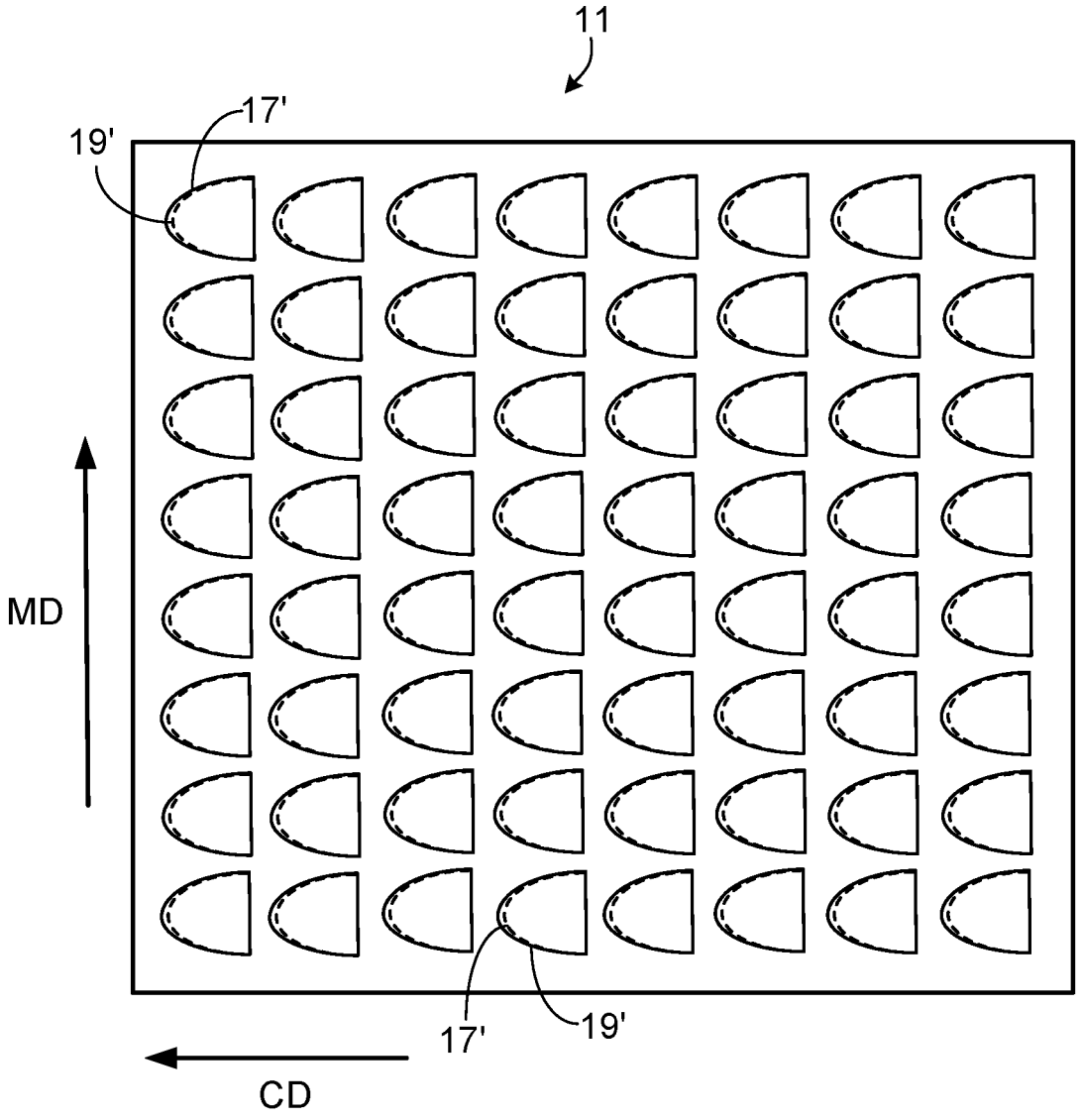

Still referring to FIG. 6, in some embodiments, the upper and/or lower edge(s) 17,19 may define a circular curve with a constant radius of curvature. To illustrate this point, the radius of curvature of lower edge 19 shown in FIG. 1 is $r_{19}$, while the radius of curvature of upper edge 17 is $r_{17}$. The radius of curvature may be, for example, from about 0.1 inch to about 1 inch (0.25 cm-2.5 cm). In other embodiments, the upper and lower edges 17, 19 may define a curve that is non-circular and, therefore, has a changing radius of curvature. Examples may include curves that are parabolic ellipsoidal or hyperbolic in shape. FIGS. 7 and 8 illustrate a closure portion 11 with parabolic upper and lower edges 17',19'.

Preferably, the maximum height H (FIG. 1) of the engageable elements 12 above the sheet-form base 14 at the apexes A1, A2 is, for example, from about 0.001 inch to about 0.250 inch (0.0025 cm-0.64 cm). In some cases, where the engageable elements resemble "fish scales," the height H is, for example, from about 0.001 inch to about 0.050 inch (0.0025 cm-0.13 cm).

The maximum length L of the engageable elements 12 in the direction of the rows is preferably, for example, from about 0.05 inch to about 1.0 inch (0.13 cm-2.5 cm), while the maximum width W in the engaging direction along the sheet-form base is, for example, from about 0.005 inch to about 0.25 inch (0.013 cm-0.64 cm). In some embodiments, the spacing S between rows in the engaging direction, measured along the sheet-form base from an end of a row to the beginning of an adjacent row is, for example, from about 0.005 inch to about 0.25 inch (0.13 cm-0.64 cm).

Figure 9:
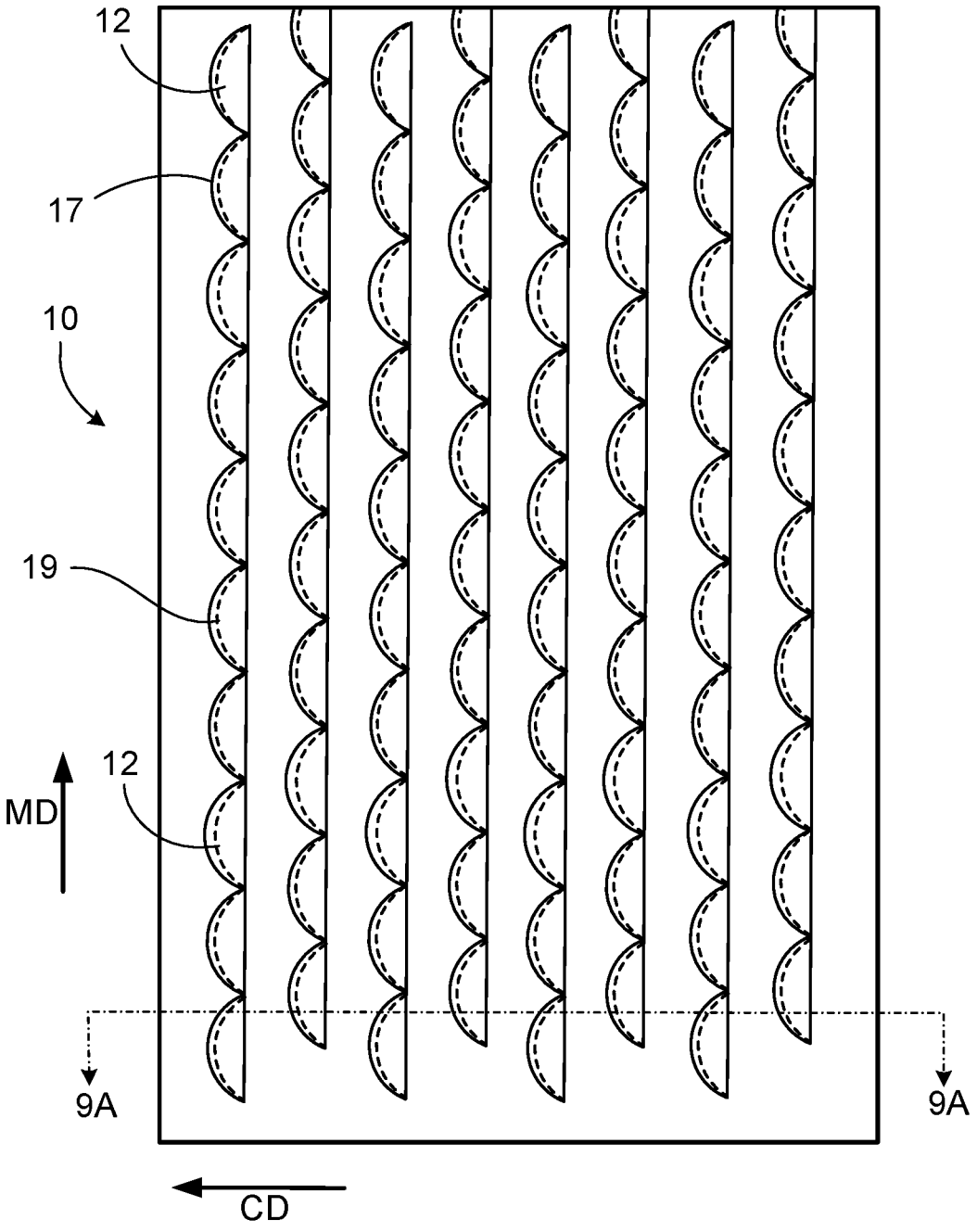
FIG. 9 is a top view of the closure portion shown in FIG. 6.
Figure 9A:
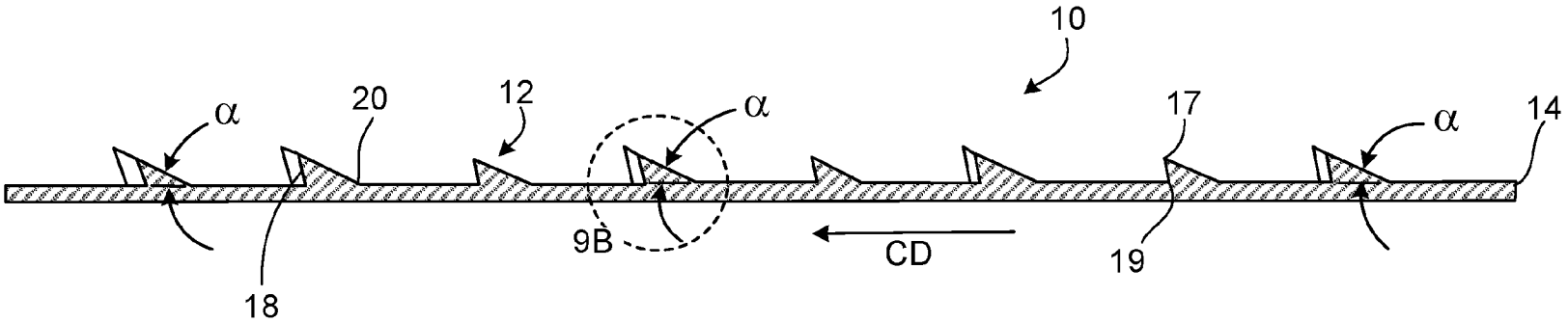
FIG. 9A is a cross-sectional view of the closure portion shown in FIG. 9, taken along line 9A-9A.
Figure 9B:
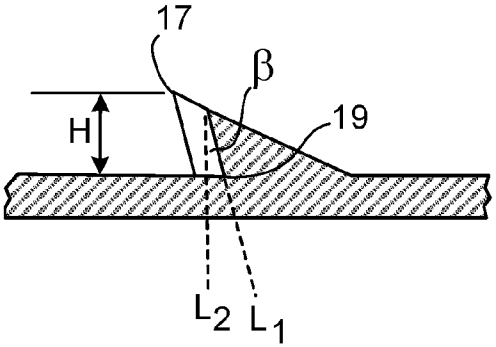
FIG. 9B is an enlarged view of area 9B in FIG. 9A.

Referring to FIGS. 9-9B, each engageable element 12 defines angles $\alpha$ and $\beta$ with respect to sheet-form base 14. Referring particularly to FIG. 9A, angle $\alpha$ is the angle formed between the top surface of the sheet-form base and the top surface of the engageable element. Referring to FIGS. 9 and 9B, lower edge 19 is not directly below upper edge 17, but is offset, the offset defining an undercut angle $\beta$. Referring to FIG. 9B, angle $\beta$ is the angle formed between a line $L_1$ connecting upper edge 17 to lower edge 19 in a plane $P_E$ in the engaging direction (FIG. 1) that is perpendicular to the sheet-form base, and a line $L_2$ in the same plane that connects upper edge 17 to the sheet-form base. In some embodiments, angle $\alpha$ is, for example, from about 5° to about 45°, while angle $\beta$ is, for example, from about 10° to about 45°. In one example $\alpha$ is 30° and $\beta$ is 15°.

Figure 10:
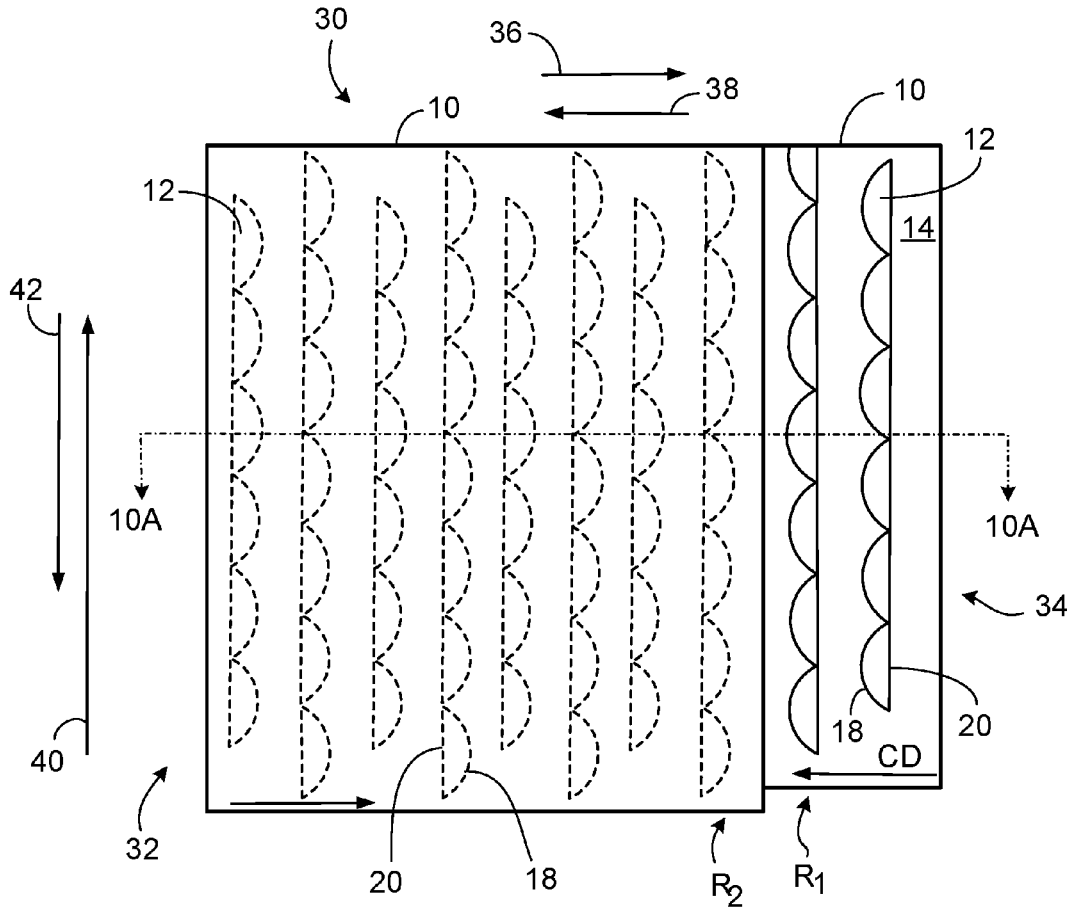
FIG. 10 is a top view of the closure portion shown in FIG. 9, engaging a like closure portion.
Figure 10A:
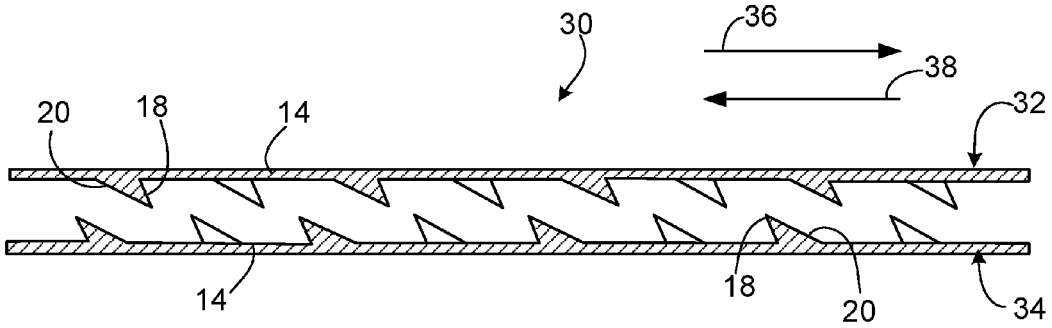
FIG. 10A is a cross-sectional view, taken along line 10A-10A in FIG. 10.
Figure 10B:
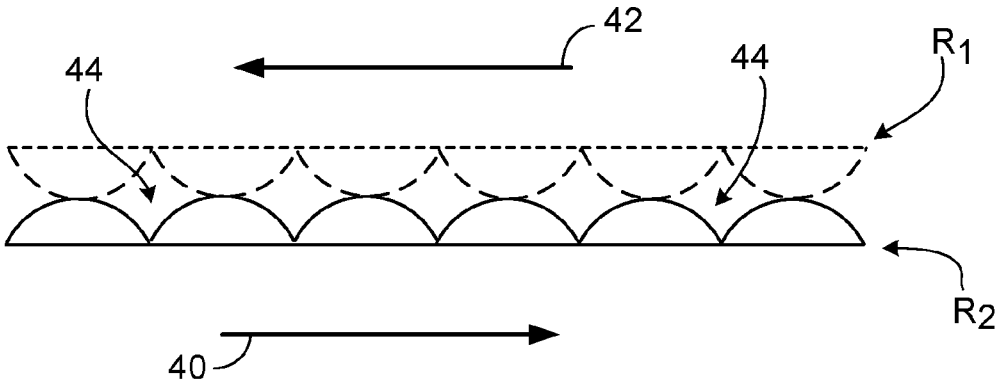
FIGS. 10B and 10C illustrate two different scallop alignments.
Figure 10C:
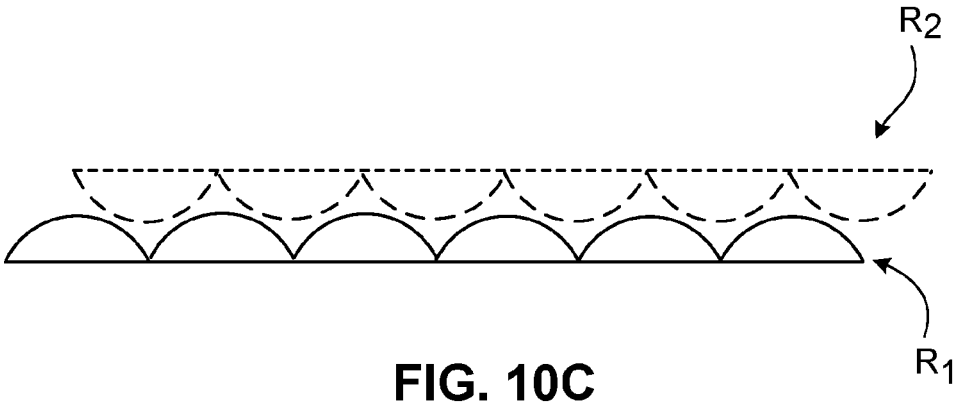

Referring to FIGS. 10-10C, a releasable closure 30 includes two closure portions 10, oriented such that the engageable elements 12 of the top closure portion 32 face the engageable elements 12 of the corresponding bottom closure portion 34. The top closure portion 32 is further oriented so that the engageable sides 18 of elements 12 point from left to right. Bottom closure portion 34 is oriented such that engageable elements 12 extend upwardly to mate with the engageable elements 12 of the top closure portion 32. The bottom closure portion 34 is further oriented so that the engageable side 18 of elements 12 point from right to left. Now, referring particularly to FIG. 10A, when the bottom closure portion 34 is fixed, such as on the body of a carton, and the top closure portion 32 is moved in a direction indicated by arrow 36, such as by closing of a lid on which the top closure portion is mounted, a high shear engagement occurs as the engageable sides 18 of the fastener elements 12 of both closure portions restrict movement in this direction. However, when the top closure portion 32 is moved in the opposite direction, indicated by arrow 38, no engagement of the top closure portion 32 with the bottom fastener component 34 occurs and the two components slide relatively freely past each other, making a soft "clicking" sound as the engageable elements slide past each other. Referring back to FIG. 10, top closure portion 32 and bottom closure portion 34 are also relatively free to slide past one another in the direction in which the rows of elements extend, i.e., the directions indicated by arrows 40 and 42. Referring particularly to FIGS. 10B and 10C, which are top views of row $R_1$ engaged with row $R_2$ (FIG. 10), when row $R_1$ is fixed and row $R_2$ is moved in a direction indicated by arrow 40 or 42, there is slight resistance to movement, as engaging elements "rise up" from wells 44 (FIG. 10B) through the maximum of engageable side 18 and come to rest in adjacent wells 44 (FIG. 10C). This feature allows the closure to accommodate positional and angular variations within the plane of engagement. Accommodating some angular misalignment and variation is particularly important for closures in which the engagement plane is perpendicular to the lid hinge pivot axis.

Figure 11:
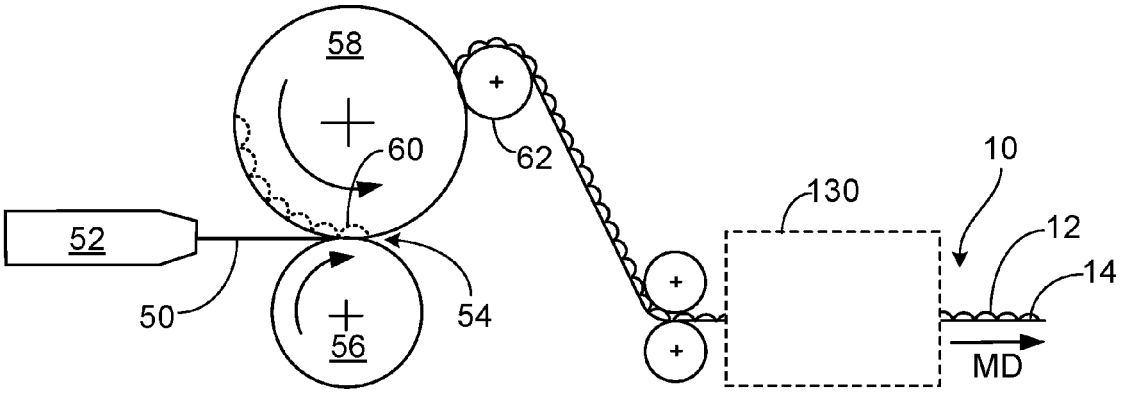
FIG. 11 is a diagrammatic view of a process for making the closure portion shown in FIG. 6.

Referring now to FIG. 11, a process for forming the closure portion 10 shown in FIG. 6 is illustrated. Thermoplastic resin 50 from extruder 52 is introduced into nip 54 formed between a supporting pressure roll 56 and a mold roll 58. Pressure in the nip causes thermoplastic resin 50 to enter blind-ended forming cavities 60 of mold roll 58 while excess resin remains about the periphery of the mold roll and is calendared to form sheet-form base 14. As the rolls 56, 58 rotate in opposite directions (shown by arrows), the thermoplastic resin proceeds along the periphery of the mold roll until it is stripped by stripper roll 62. After removal from the mold roll, a pressure sensitive adhesive and release liner can be applied in a corresponding station 130. The resulting closure portion 10 is described above. The direction of travel of the material illustrated in FIG. 11 is referred to as the "machine direction" (MD) of the material and defines the longitudinal direction of the resulting product 10, while the cross-machine direction (CD) is perpendicular to the machine direction. Further details regarding processing are described in Fischer, U.S. Pat. No. 4,775,310, the disclosure of which is hereby incorporated in full by reference.

Figure 12:
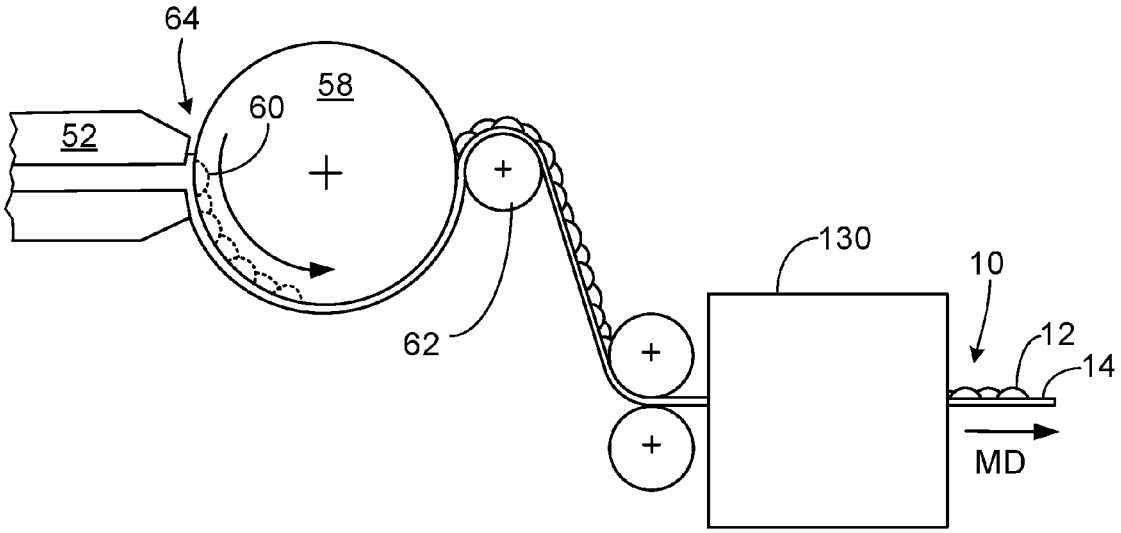
FIG. 12 is a diagrammatic view of an alternative process for making the closure portion shown in FIG. 6.

In another embodiment, illustrated in FIG. 12, an alternate technique for producing closure portion 10 of FIG. 6 is employed. The process is similar to that described above with reference to FIG. 11, except only a mold roll 58 is used, i.e., no pressure roll 56 is necessary. Here, the extruder 52 is shaped to conform to the periphery of the mold roll and the extruded resin 50 is introduced directly to a gap 64 formed between the mold roll and the extruder 52. From here, flexible closure portion 10 is stripped from the mold cavities 60 by stripper roll 62 as described above. Further details regarding this process are described by Akeno in U.S. Pat. Nos. 5,781,969 and 5,913,482, the disclosures of which are hereby incorporated in full by reference.

Figure 13:
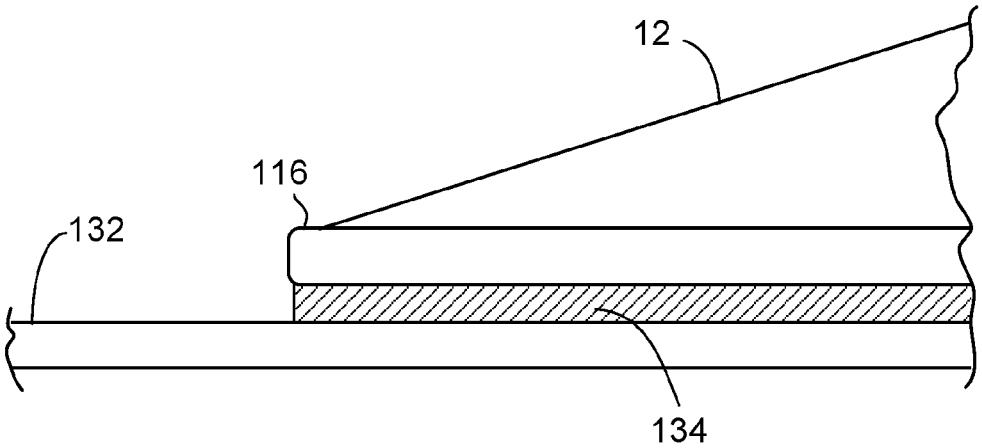
FIG. 13 is an enlarged view of an adhesive attachment of a closure portion to a paperboard surface.

Referring now to FIG. 13, the closure portions (116 and 118, as seen in FIG. 1) can be applied to the paperboard surface 132 of the carton body or lid as an adhesive-backed label, using standard labelling equipment during the formation of the paperboard carton blank. During application, a release liner (not shown) would typically be stripped from the back surface of the closure portion to expose the pressure-sensitive adhesive 134, which is then adhered directly to the paperboard surface.

Figure 14:
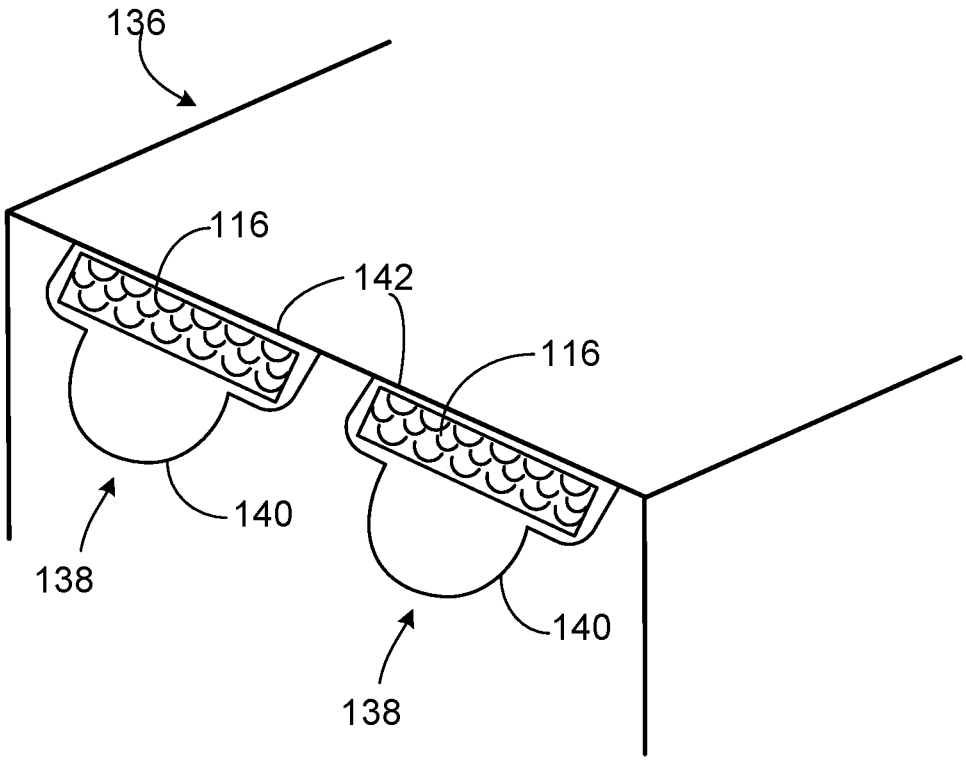
FIG. 14 shows a carton with two front face closure tabs.
Figure 14A:
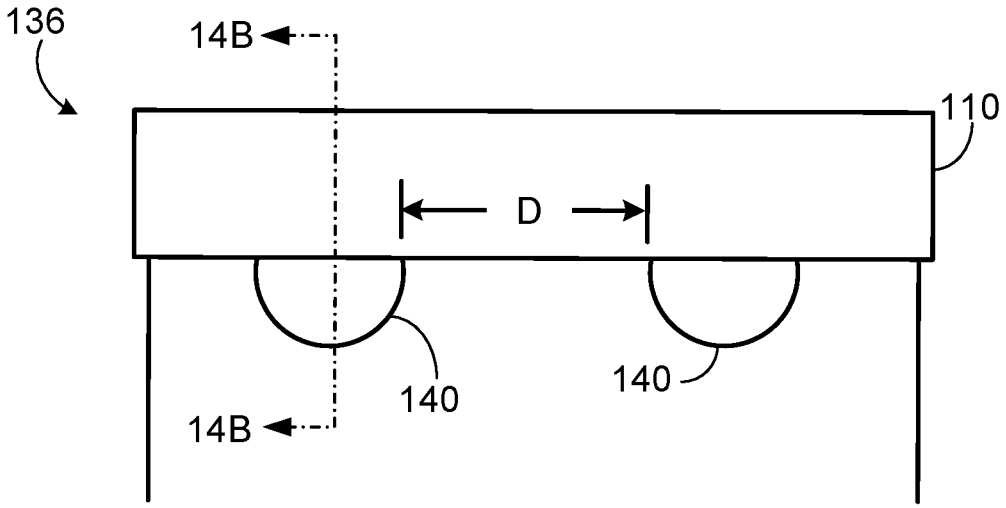
FIG. 14A is a front view of the carton of FIG. 14 with the hinged lid closed.
Figure 14B:
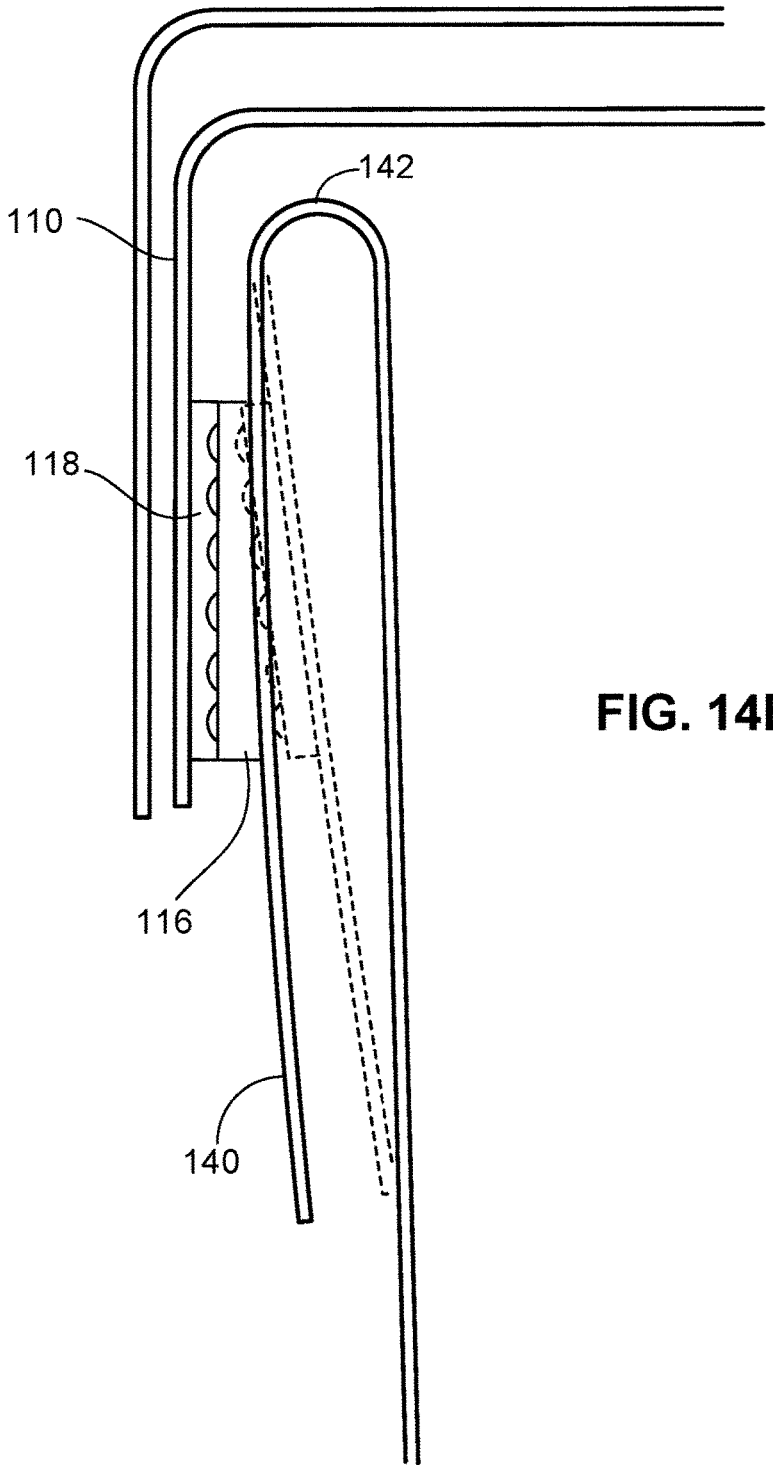
FIG. 14B is a cross-sectional view, taken along line 14B-14B in FIG. 14A.

The ideas presented above can be applied to other carton constructions. For example, FIGS. 14-14B show a hinged lid carton 136 in which closure release tabs 138 are formed as folded extensions of the front face of the carton, opposite the lid hinge. Each release tab carries a body closure portion 116 exposed on its outer surface, and forms a depressable extension 140 that extends below the lower lip of the lid 110 when the carton is closed. Residual bending resistance at the fold 142 where the tabs join the front face of the carton keep the tabs angled away from the front face of the carton in an unloaded state, and their body closure portions 116 pushed into contact with the lid closure portions 118. To release the closures, the extensions 140 are pressed toward the front face of the carton body (as shown in dashed outline in FIG. 14B), thereby disengaging the mated ridges of the closure portions and allowing the lid to be easily opened. The extensions each operate to release a respective closure and their exposed portions may be separated by a distance D sufficient to not permit simultaneous depression with a single hand of a child. In this manner, they may provide some level of child-deterrence. For example, they may be separated by a distance D of 100 mm.

Figures 15, 15A:
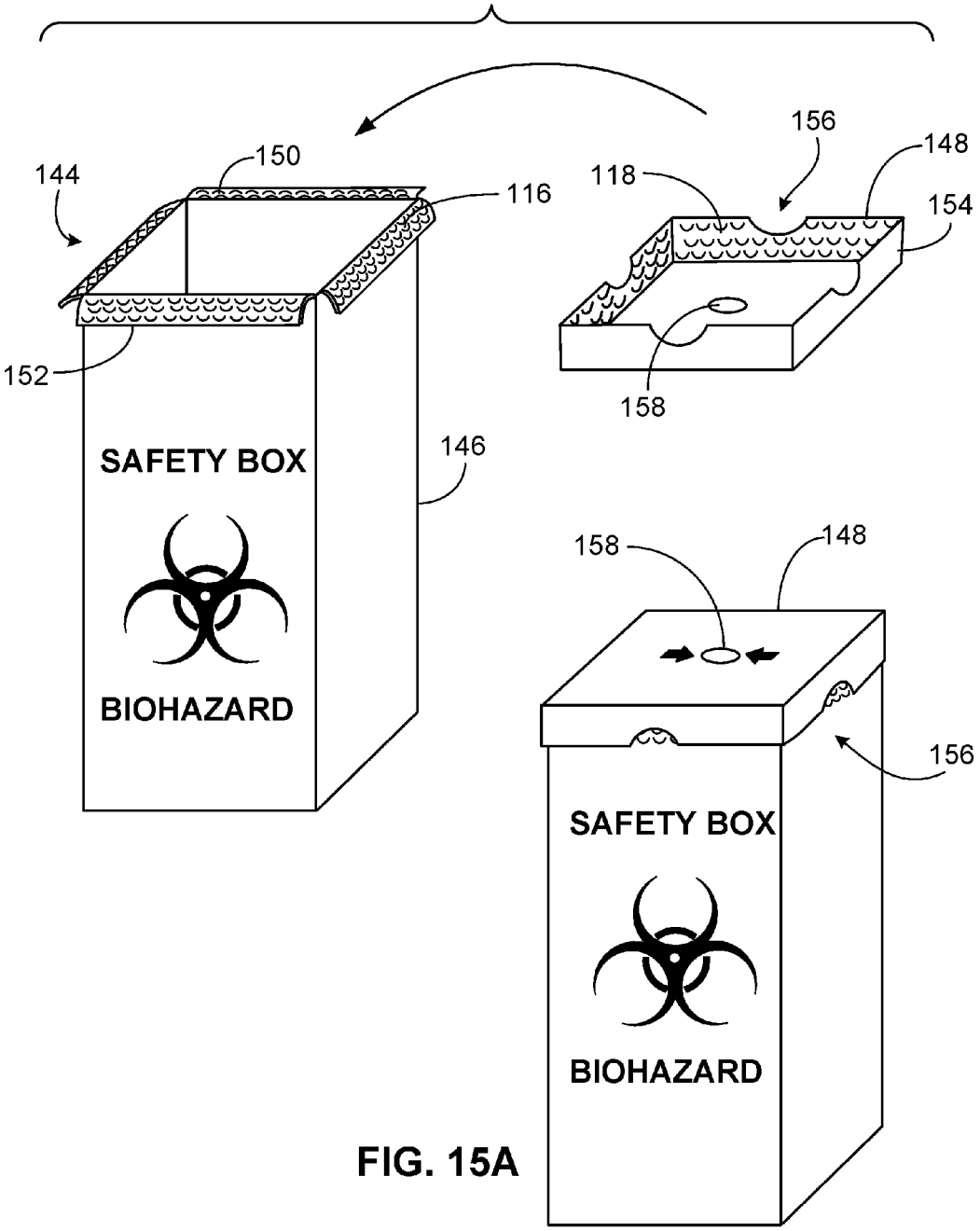
FIG. 15 is a disassembled perspective view of a sharps container.
FIG. 15A is a perspective view of the sharps container of FIG. 15, with the lid closed.

FIGS. 15 and 15A show a carton 144 with a box-shaped body 146 and a separate lid 148. Body 146 defines an opening between four upper side edges 150. A flange 152 extends outward from each side edge 150 and carries a body closure portion 116 covering essentially all of the upper surface of the flange. The mating lid 148 has a skirt 154 depending from the lateral edges of the lid and carrying on its inner surface the lid closure portion 118, covering essentially the entire inner surface of the skirt. When the lid is placed over the carton body, the skirt envelops flanges 152, engaging the body and closure portions as described above. The closed lid covers flanges 152 except within cutouts 156 on each side of the skirt, in which portions of the underlying flange is exposed. The flanges may be depressed against the sides of the carton body at the cutouts, to release the closures on all four sides of the carton. Spacing of the cutouts may be such that two hands are required for lid removal. In this particular illustration, carton 144 is configured as a disposable sharps receptacle, with a hole 158 in the lid through which hazardous waste is deposited into the carton for disposal.

Figure 16:
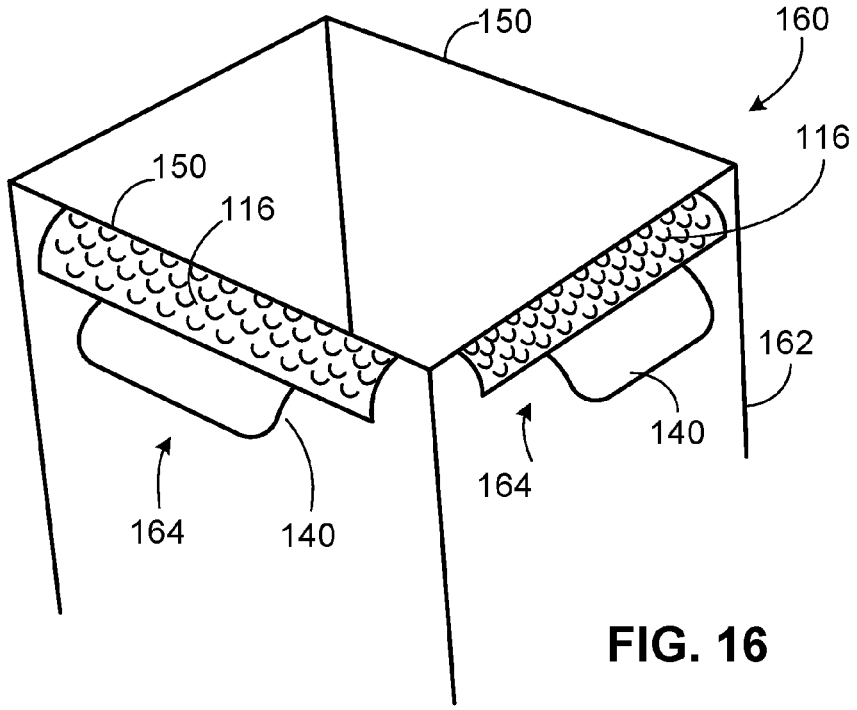
FIG. 16 shows a carton with closure tabs on different carton faces.
Figure 16A:
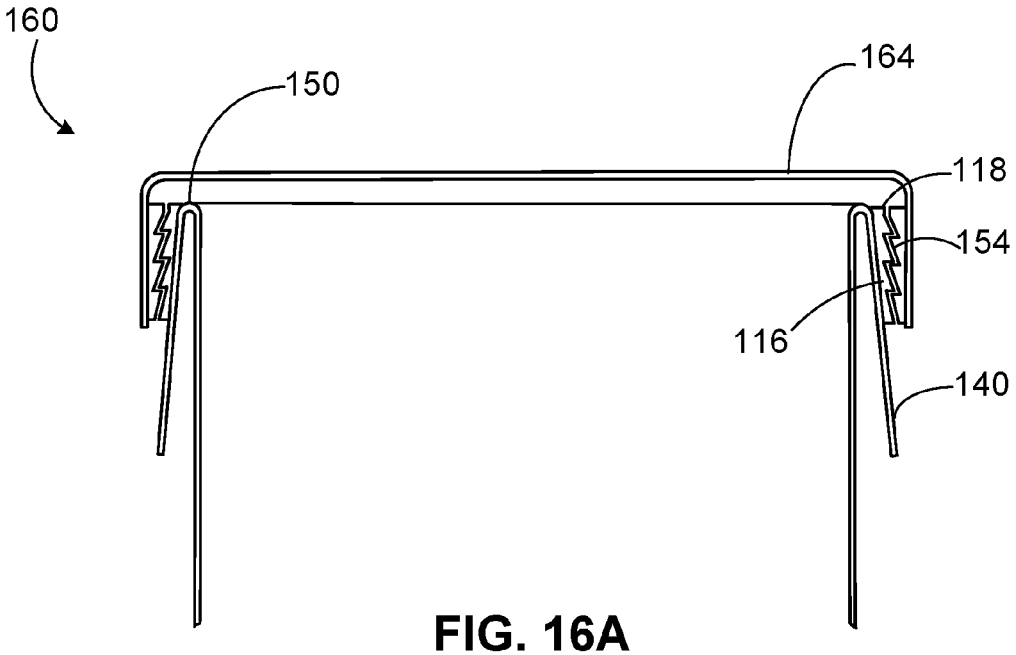
FIG. 16A is a cross-sectional view through the carton of FIG. 16, with a mating lid closed.

In the example of FIGS. 16 and 16A, a carton 160 has a separate body 162 and lid 164. Closure tabs 164 extend from folds at the upper edges 150 and carry body closure portions 116 as described above. Each tab 164 includes a depressible extension 140 that extends below the skirt 154 of the lid when the box is closed, and can be resiliently deflected toward the underlying face of the carton body by gentle pressure applied manually, thus disengaging its associated closure as described above with respect to FIGS. 14-14B. In this example, each of the four sides of the carton body has such a tab 164, with two adjacent tabs operable by a single hand width across a corner of the carton. In another example (not shown), only two, opposite sides of the carton body have such closure tabs.

While a number of examples have been described for illustration purposes, the foregoing description is not intended to limit the scope of the invention, which is defined by the scope of the appended claims. There are and will be other examples and modifications within the scope of the following claims.

What is claimed is:

1. A reclosable carton comprising a carton body having four walls and a bottom and defining an opening into an interior compartment defined between the walls, the walls and bottom comprising respective portions of a folded piece of paperboard;

a carton lid having flanges that overlap upper portions of at least two of the walls of the carton body with the lid in a closed position; and a carton closure comprising a body closure portion adhered to an outer surface of an upper portion of one of the carton body walls as a first adhesive-backed label, and a lid closure portion adhered to an inner surface of one of the carton lid flanges as a second adhesive-backed label, the lid closure portion arranged to overlap the body closure portion with the lid in its closed position;

wherein each of the body and lid closure portions has an exposed surface defining a series of tapered ridges spaced apart in the box lid closing direction, the body and closure portions positioned to slidingly engage in a ratcheting manner in which a tapered ridge of the series defined by the exposed surface of the lid sequentially engages multiple ridges of the body closure portion as the lid is closed, to hold the lid in its closed position;

wherein the ridges of the body and lid closure portions are each formed of thermoplastic resin and each ridge comprises a row of multiple engageable elements integrally molded with and extending outwardly from one side of an associated sheet-form base, each element comprising a wedge-shaped scallop having an engageable side and a non-engageable side conterminous at a curved upper edge of the element; and wherein the carton closure is configured to be released by a closure separation motion normal to the carton lid flange inner surface, to separate the engaged ridges of the body and lid closure portions.

2. The reclosable carton of claim 1, wherein the thermoplastic resin of the ridges has a durometer of between 10 and 100 Shore D, as tested according to ASTM 2240.

3. The reclosable carton of claim 1, wherein the carton lid extends from one of the walls of the carton body at a paperboard hinge.

4. The reclosable carton of claim 3, wherein the body closure portion is disposed adjacent a corner of the carton opposite the hinge.

5. The reclosable carton of claim 1, wherein the body closure portion is attached to a body flange depending from an upper edge of the body as part of an upper portion of a body side wall.

6. The reclosable carton of claim 1, wherein the upper edge of each engageable element defines a curve in top view, and wherein the engageable sides of a majority of the elements are oriented in a common direction.

7. The reclosable carton of claim 1, wherein the scallops face such that their non-engageable sides make initial contact with the scallops of the other closure portion during lid closure.

8. The reclosable carton of claim 1, wherein the scallops are arranged in multiple rows, with scallops of adjacent rows offset from one another along their respective rows by about one-half a nominal spacing between adjacent scallops within a row.

9. The reclosable carton of claim 1, wherein the engageable sides of the wedge-shaped elements overhang the sheet-form base.

10. The reclosable carton of claim 1, wherein the body and lid closure portions are of identical structure.

11. The reclosable carton of claim 1, wherein the body and lid closure portions are formed entirely of the thermoplastic resin.

12. The reclosable carton of claim 1, wherein the body and lid closure portions are adhered by pressure-sensitive adhesive.

13. The reclosable carton of claim 1, wherein the body closure portion comprises two body closure sections spaced apart on the carton body and separated by exposed carton body surface; and the lid closure portion comprises two lid closure sections spaced apart on the carton lid and separated by exposed carton lid surface;

each body closure section aligned with a respective lid closure section to overlap upon lid closure to secure the lid in its closed position.

14. The reclosable carton of claim 13, wherein the two body closure sections is disposed on opposite sides of the carton body.

15. The reclosable carton of claim 13, wherein the carton body walls and lid flanges are sufficiently flexible to enable the closure separation motion by pressing inward on the exposed carton body surface between the two body closure sections.

16. The reclosable carton of claim 1, wherein the flanges of the lid are joined to form a skirt about a perimeter of the lid, and wherein the lid is completely removable from the body by releasing the closure.

17. The reclosable carton of claim 1, wherein the body closure portion is attached to a body flange depending from an upper edge of the body as part of an upper portion of a body side wall, such that the skirt of the lid overlaps the body flange with the lid it its closed position.

18. The reclosable carton of claim 17, wherein the body closure portion comprises multiple body closure sections carried on respective body flanges on respective sides of the carton body, and wherein the lid closure portion comprises multiple lid closure sections carried on respective inner surfaces of the lid skirt so as to engage the body closure sections on multiple sides of the carton.

19. The reclosable carton of claim 1, wherein the sides of the carton body have a Gurley stiffness of between 15,000 and 100,000 Gurley units (mg of force), as tested according to TAPPI test method T543.

20. The reclosable carton of claim 1, wherein the carton lid and the sides of the carton body are formed of coated paper.

21. The reclosable carton of claim 1, wherein the engageable sides and the non-engageable sides of each scallop are portions of a continuous exposed resin surface.

22. The reclosable carton of claim 21, wherein the exposed resin surface is aperture-free.

23. The reclosable carton of claim 1, wherein the closure separation motion is normal to the box lid closure direction.

24. The reclosable carton of claim 1, wherein the carton body walls and lid flanges are sufficiently flexible to enable the closure separation motion by flexure of the carton body or lid.

* * * * *